US005927444A

United States Patent [19]

Checketts

[11] Patent Number: 5,927,444

[45] Date of Patent: Jul. 27, 1999

[54] BRAKE FOR A TRACK-OPERATED VEHICLE

[76] Inventor: Stanley J. Checketts, 900 E. Canyon Rd., Providence, Utah 84332

[21] Appl. No.: 08/915,528

[22] Filed: Aug. 15, 1997

[51] Int. Cl.[6] ..... B61K 7/02

[52] U.S. Cl. ..... 188/62; 188/41; 188/107

[58] Field of Search ..... 188/62, 2 R, 41, 188/42, 43, 44, 45, 32, 35, 36, 107; 104/249, 257, 259, 258; 238/138; 472/131, 50, 134

[56] References Cited

U.S. PATENT DOCUMENTS

| | | | |
|---|---|---|---|
| 210,244 | 11/1878 | Dingley | 188/62 |
| 1,611,200 | 12/1926 | Kellenberger | 188/62 |
| 1,612,865 | 1/1927 | Hannauer et al. | 188/62 |
| 1,647,575 | 11/1927 | Nelson | 188/62 |
| 1,682,746 | 9/1928 | Finnessy | 188/62 |
| 1,812,190 | 6/1931 | Bäseler | 188/107 |
| 1,845,274 | 2/1932 | Howard | 188/62 |
| 1,906,359 | 5/1933 | Begley et al. | 188/62 |
| 3,111,265 | 11/1963 | Huber | 188/62 |
| 3,321,048 | 5/1967 | Wigton et al. | 188/62 |
| 3,656,588 | 4/1972 | Preinfalk et al. | 188/62 |
| 3,703,943 | 11/1972 | Preinfalk et al. | 188/62 |
| 3,858,524 | 1/1975 | Stones | 188/62 |
| 3,952,839 | 4/1976 | Brown et al. | 188/62 |
| 4,003,451 | 1/1977 | Torok | 188/62 |
| 4,014,413 | 3/1977 | Monks | 188/44 |
| 4,195,576 | 4/1980 | Gutridge | 188/43 |
| 4,221,170 | 9/1980 | Koudelka . | |
| 4,236,454 | 12/1980 | Erickson et al. | 188/43 |
| 4,246,846 | 1/1981 | Betschart | 188/42 |
| 4,267,902 | 5/1981 | Schüpbach et al. | 188/62 |
| 4,335,658 | 6/1982 | Vanderkelen | 188/41 |
| 4,901,648 | 2/1990 | Moore et al. | 188/62 |
| 5,211,266 | 5/1993 | Meyer | 188/62 |
| 5,551,347 | 9/1996 | Gutknecht . | |
| 5,575,218 | 11/1996 | Gutknecht | 188/62 |

*Primary Examiner*—Douglas C. Butler
*Attorney, Agent, or Firm*—Thompson E. Fehr

[57] ABSTRACT

A brake for a track-operated vehicle employing the use of friction between at least one brake pad to be mounted on the vehicle and at least one frictional strip for attached to a lateral side of the track. The brake pad is to be attached to the vehicle by a device for urging the brake pad toward a lateral side of the track to which a frictional strip has been attached to such an extent that when the vehicle is maintained in alignment with the track, the inner surface of said brake pad will attain a position, in the absence of the frictional strip, that is intermediate between the lateral side of the track and the position where the outer side of the frictional strip would be located were such first frictional strip installed. Similarly, an auxiliary brake has a bar that fits across the track and two brake pads attached to the bar in the same manner as brake pads are attached to the vehicle.

7 Claims, 3 Drawing Sheets

BRAKE FOR A TRACK-OPERATED VEHICLE

BACKGROUND OF THE INVENTION

FIELD OF THE INVENTION

This invention relates to a brake for decelerating vehicles which operate upon a track.

DESCRIPTION OF THE RELATED ART

Both U.S. Pat. No. 5,551,347 of Leroy H. Gutknecht and U.S. Pat. No. 5,575,218 of Tyrone E. Powell disclose pneumatic brakes mounted in the track which close to grasp the downward extending fin when it is desired to brake the vehicle. Brakes similar to those of the Gutknecht patent are, furthermore, claimed in U.S. Pat. No. 5,575,218 of Leroy H. Gutknecht.

A number of patents, moreover, have been granted for vehicles (other than "race cars") the brakes for which operate in a manner opposite to the brakes of Gutknecht and Powell. In U.S. Pat. Nos. 4,195,576; 4,221,170; 4,236,454; 4,246,846; and 4,335,658 a brake pad is maintained some distance from a track upon which a vehicle is moving until it is desired to slow or stop the vehicle, when the brake pad is forced against the track (by means of a lever except for the case of U.S. Pat. No. 4,195,576, the invention of which utilizes a hydraulic cylinder for this purpose). And the device of U.S. Pat. No. 4,014,413 has a brake which functions similarly to those of the series of patents discussed earlier within this paragraph; the vehicle (a mining machine) does not, however, travel upon the track but "moves along a path adjacent to . . . [the] anchored rail . . ."

The System for Halting Runaway Electrically Powered Train in U.S. Pat. No. 3,858,524 of Roy C. Stones provides a braking effect which does not require an individual to operate a control device such as a lever or a hydraulic cylinder. A U-shaped skid block is mounted beneath a train and has brake lining material on its surface. Extending parallel to the track upon which the train rides is a "split skid track." The "split skid track," itself, incorporates two rails which are urged apart from one another by springs. Only in the drawings is it shown that the end of the "split skid track" is pointed or rounded to facilitate entry of the "split skid track" into the U-shaped skid block. Even so, such entry will be accomplished only if the train remains properly aligned upon the track on which the train is running.

SUMMARY OF THE INVENTION

For the present invention, between the first (beginning) end and the second (finish) end of a track a first frictional strip is attached to a first lateral side of the track. This first frictional strip continues along the first lateral side of the track toward the second end of the track. Preferably, a second frictional strip is similarly attached to a second lateral side of the track. A first brake pad is to be attached to a vehicle which operates on the track in such a manner that when the vehicle is maintained in alignment with the track, the first brake pad contacts the first frictional strip to produce a braking force. Similarly, in the preferred embodiment, a second brake pad is to be attached to the vehicle in such a manner that the second brake pad contacts the second frictional strip to increase the braking force. Moreover, should the vehicle begin to move out of alignment on the track toward one lateral side of the track, greater pressure and, therefore, greater friction will be generated by the brake pad and its associated frictional strip on the lateral side of the track away from the direction of movement, which will result in forcing the vehicle back toward proper alignment on the track.

Furthermore, on an open course (as opposed to a closed course, such as an oval, where the beginning end of the track is adjacent to the finish end of the track), an auxiliary brake, which spans the track, may be employed to assure that the vehicle does not continue past the finish and leave the track.

DESCRIPTION OF THE PREFERRED EMBODIMENT

Figure 1:
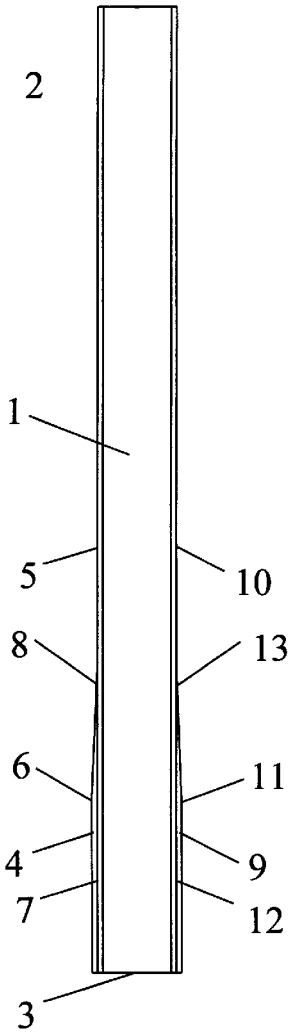
FIG. 1 presents an overhead view of an open-course track utilizing this invention.

As illustrated in FIG. 1, between a beginning end 2 and a finish end 3 of a track 1 a first frictional strip 4 is attached to a first lateral side 5 of the track 1. This first frictional strip 4 continues along the first side 5 of the track 1 toward the finish end 3 of the track 1. Preferably, the outer side 6 of the first frictional strip 4 tapers toward the inner side 7 of the first frictional strip 4 and meets said inner side 7 at the first end 8 of the first frictional strip 4.

Figure 2:
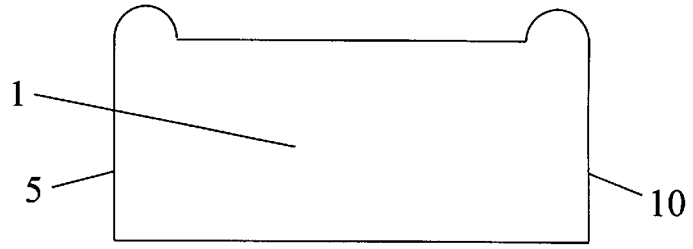
FIG. 2 shows the transverse cross section of the track.
Figure 3:
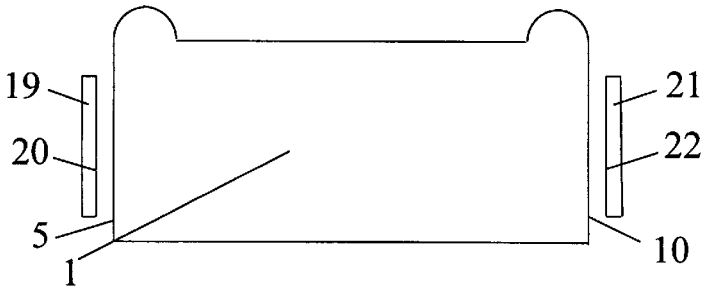
FIG. 3 is a transverse cross-sectional view depicting the relationship of brake pads on a vehicle in relation to a cross section of the track where no frictional strips have been incorporated.
Figure 4:
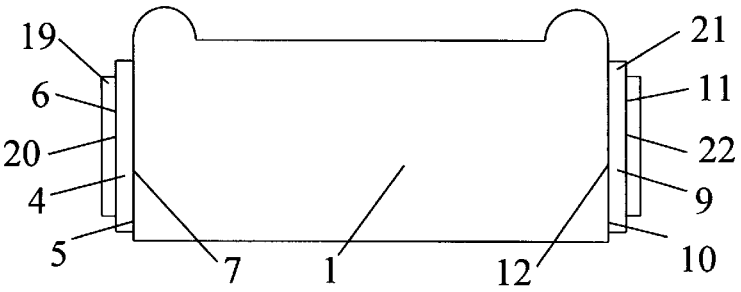
FIG. 4 is a transverse cross-sectional view showing the relationship of the brake pads on the vehicle in relation to a cross section of the track where frictional pads have been attached to both lateral sides of the track.

As depicted in FIG. 2, FIG. 3, and FIG. 4, the track 1 has a generally rectangular cross section.

Preferably, between the beginning end 2 and the finish end 3 of the track 1 a second frictional strip 9 is similarly attached to a second lateral side 10 of the track 1. This second frictional strip 9 continues along the second lateral side 10 of the track 1 toward the finish end 3 of the track 1. Preferably, the outer side 11 of the second frictional strip 9 tapers toward the inner side 12 of the second frictional strip 9 and meets said inner side 12 at the first end 13 of the second frictional strip 9.

A first brake pad 19 is attached to a vehicle that travels along the track 1 in such a manner that the first brake pad 19 is urged in any manner that is well known in the art—for example, by a resilient member such as a spring or air cylinder—toward the first lateral side 5 of the track 1 to such an extent that when the vehicle is maintained in alignment with the track 1, the inner surface 20 of the first brake pad 19 will attain a position—in the absence of the first frictional strip 4—that is intermediate between the first lateral side 5 of the track 1 and the position where the outer side 6 of the first frictional strip 4 would be located were such first frictional strip 4 installed.

Consequently, once the vehicle—in moving toward the finish end 3 of the track 1—reaches the first frictional strip 4, the frictional force between the inner surface 20 of the first brake pad 19 and the outer side 6 of the first frictional strip 4 will produce a braking force to decelerate and stop the vehicle.

Preferably, a second brake pad 21 is attached to the vehicle in such a manner that the second brake pad 21 is urged in any manner that is well known in the art—for example, by a resilient member such as a spring or air cylinder—toward the second lateral side 10 of the track 1 to such an extent that when the vehicle is maintained in alignment with the track 1, the inner surface 22 of the second brake pad 21 will attain a position—in the absence of the second frictional strip 9—that is intermediate between the second lateral side 10 of the track 1 and the position where the outer side 11 of the second frictional strip 9 would be located were such second frictional strip 9 installed. (It is possible, though, to eliminate the urging means in the case of the second brake pad 21.)

Consequently, once the vehicle—in moving toward the finish end 3 of the track 1—reaches the second frictional strip 9, the frictional force between the inner surface 22 of the second brake pad 21 and the outer side 11 of the second frictional strip 9 will produce a braking force to decelerate and stop the vehicle.

Moreover, when both a second brake pad 21 and a second frictional strip 9 are utilized, should the vehicle begin to move out of alignment on the track toward one lateral side of the track, greater pressure and, therefore, greater friction will be generated by the brake pad 19 or 21 and its associated frictional strip 4 or 9 on the lateral side 5 or 10 of the track 1 away from the direction of movement and will necessarily force the vehicle back toward a proper alignment on the track 1.

On a closed course (such as an oval), any means that is well known in the art may be utilized either (a) to move the first brake pad 19 away from the first lateral side 5 of the track 1 and the second brake pad 21 away from the second lateral side 10 of the track 1 each time the vehicle approaches the frictional strips 4, 9 until it is desired to stop the vehicle or (b) to maintain the brake pads 19, 21 away from the frictional strips 4, 9 until it is desired to stop the vehicle, at which time the brake pads 19, 21 will be moved into position to contact the frictional strips 4, 9.

Figure 5:
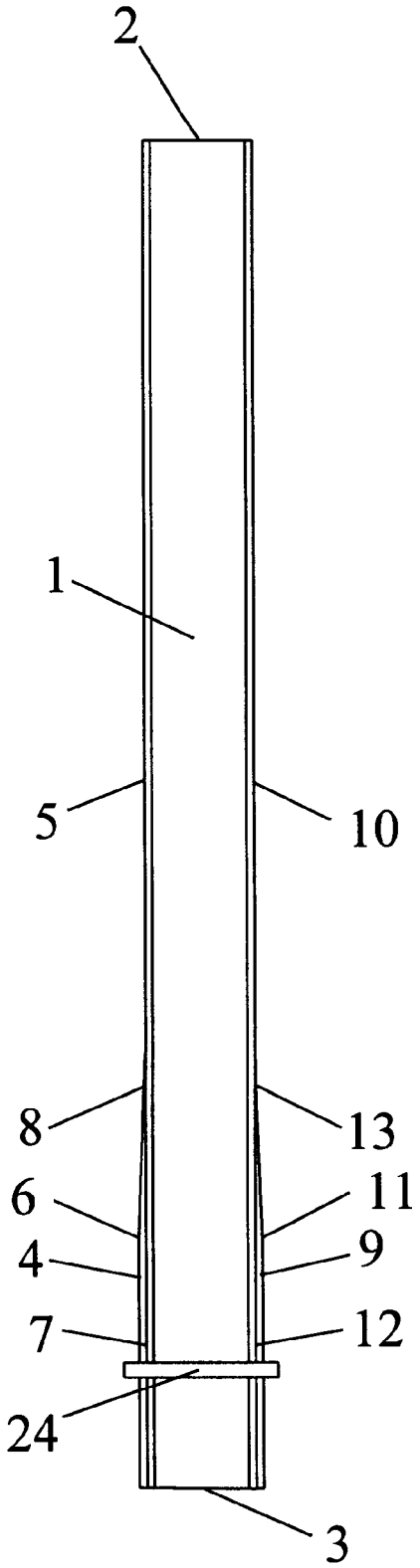
FIG. 5 is a view similar to that of FIG. 1 but adding to the embodiment of FIG. 1 an auxiliary brake.

Optionally, as also shown in FIG. 5, an auxiliary brake 24 may be installed on an open course to stop the vehicle should the first brake pad 19 and the second brake pad 21 fail to function properly.

Figure 6:
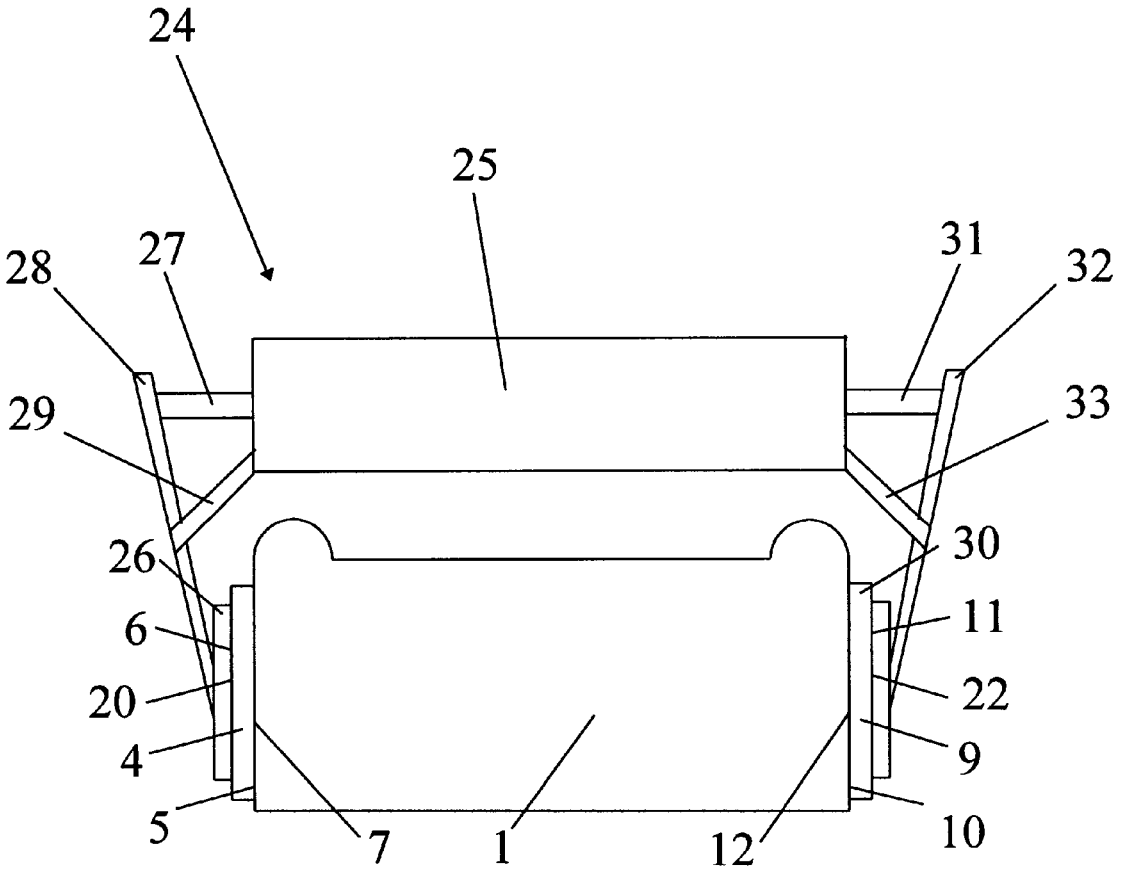
FIG. 6 is a transverse cross-sectional view illustrating the construction of the auxiliary brake.

The auxiliary brake 24 is composed, as illustrated in FIG. 6, of a bar 25 that fits across the track 1 together with a third brake pad 26 which is attached to the bar 25 in such a manner that the third brake pad 26 is urged in any manner that is well known in the art—for example, by a resilient member 27 such as a spring or air cylinder located between and attached to the bar 25 and a support 28 which is connected to the third brake pad 26 and pivotally attached to a diagonal support 29 that is rigidly attached to the bar 25—against the outer side 6 of the first frictional strip 4 to produce a frictional braking force and a fourth brake pad 30 which is attached to the bar 25 in such a manner that the fourth brake pad 30 is urged in any manner that is well known in the art—for example, by a second resilient member 31 such as a spring or air cylinder located between and attached to the bar 25 and a second support 32 which is connected to the fourth brake pad 30 and pivotally attached to a second diagonal support 33 that is rigidly attached to the bar 25—against the outer side 11 of the second frictional strip 9 to produce a frictional braking force. (Although not preferable, the fourth brake pad 30 could be replaced by a structurally similar device having less friction to be used primarily for structural support.)

I claim:

1. A brake for a vehicle operated on a track having a beginning end, a finish end, a first lateral side, and a second lateral side, which comprises:

on at least one lateral side of said track, between the beginning end of the track and the finish end of the track, a frictional strip attached to said track; and a brake pad to be attached to said vehicle by a means for urging said brake pad toward a lateral side of the track to which a frictional strip has been attached to such an extent that when the vehicle is maintained in alignment with the track, the inner surface of said brake pad will attain a position, in the absence of the frictional strip, that is intermediate between the lateral side of the track and the position where the outer side of the frictional strip would be located were such first frictional strip installed so that said brake pad and said frictional strip will decelerate the vehicle.

2. The brake for a vehicle operated on a track having a beginning end, a finish end, a first lateral side, and a second lateral side as recited in claim 1, further comprising:

an auxiliary brake which, itself, comprises a bar that fits across the track and is attached to a brake pad by a means for urging said brake pad toward a lateral side of the track to which a frictional strip has been attached to such an extent that a frictional braking force is produced between the frictional strip and the brake pad attached to the bar.

3. A brake for a vehicle operated on a track having a beginning end, a finish end, a first lateral side, and a second lateral side, which comprises:

a first frictional strip attached to a first lateral side of said track between the beginning end of the track and the finish end of the track;

a second frictional strip attached to a second lateral side of said track between the beginning end of the track and the finish end of the track;

a first brake pad to be attached to said vehicle by a means for urging said brake pad toward the first lateral side of the track to such an extent that when the vehicle is maintained in alignment with the track, the inner surface of said first brake pad will attain a position, in the absence of the first frictional strip, that is intermediate between the first lateral side of the track and the position where the outer side of the first frictional strip would be located were such first frictional strip installed so that said first brake pad and said first frictional strip will generate a frictional force which will decelerate the vehicle; and a second brake pad attached to said vehicle by a means for urging said brake pad toward the second lateral side of the track to such an extent that when the vehicle is maintained in alignment with the track, the inner surface of said second brake pad will attain a position, in the absence of the second frictional strip, that is intermediate between the second lateral side of the track and the position where the outer side of the second frictional strip would be located were such second frictional strip installed so that said second brake pad and said second frictional strip will generate a frictional force which will decelerate the vehicle.

4. The brake for a vehicle operated on a track having a beginning end, a finish end, a first lateral side, and a second lateral side as recited in claim 3, further comprising:

an auxiliary brake which, itself, comprises a bar that fits across the track and is attached to a brake pad by a means for urging said brake pad toward a lateral side of the track to which a frictional strip has been attached to such an extent that a frictional braking force is produced between the frictional strip and the brake pad attached to the bar.

5. A brake for a vehicle operated on a track having a beginning end, a finish end, a first lateral side, and a second lateral side, which comprises:

a first frictional strip attached to a first lateral side of said track between the beginning end of the track and the finish end of the track;

a second frictional strip attached to a second lateral side of said track between the beginning end of the track and the finish end of the track;

a bar that fits across the track;

a first brake pad attached to said bar by a means for urging said brake pad toward the first lateral side of the track, to which the first frictional strip has been attached, to such an extent that a frictional braking force is produced between the first frictional strip and the brake pad attached to the bar; and a second brake pad attached to said bar by a means for urging said brake pad toward the second lateral side of the track, to which the second frictional strip has been attached, to such an extent that a frictional braking force is produced between the second frictional strip and the second brake pad attached to the bar.

6. A process for braking the movement of a vehicle operated on a track having a beginning end, a finish end, a first lateral side, and a second lateral side, which comprises:

attaching to said track a frictional strip on at least one lateral side of the track between the beginning end of the track and the finish end of the track; and permitting to contact one or more frictional strips a brake pad attached to said vehicle by a means for urging said brake pad toward a lateral side of the track to which a frictional strip has been attached to such an extent that when the vehicle is maintained in alignment with the track, the inner surface of said brake pad will attain a position, in the absence of the frictional strip, that is intermediate between the lateral side of the track and the position where the outer side of the frictional strip would be located were such first frictional strip installed.

7. A process for braking the movement of a vehicle operated on a track having a beginning end, a finish end, a first lateral side, and a second lateral side, which comprises:

attaching to said track a first frictional strip attached to the first lateral side of said track between the beginning end of the track and the finish end of the track;

attaching to said track a second frictional strip attached to a second lateral side of said track between the beginning end of the track and the finish end of the track; and permitting to contact said first frictional strip a first brake pad attached to said vehicle by a means for urging said brake pad toward the first lateral side of the track to such an extent that when the vehicle is maintained in alignment with the track, the inner surface of said first brake pad will attain a position, in the absence of the first frictional strip, that is intermediate between the first lateral side of the track and the position where the outer side of the first frictional strip would be located were such first frictional strip installed; and permitting to contact the second frictional strip a second brake pad attached to said vehicle by a means for urging said brake pad toward the second lateral side of the track to such an extent that when the vehicle is maintained in alignment with the track, the inner surface of said second brake pad will attain a position, in the absence of the second frictional strip, that is intermediate between the second lateral side of the track and the position where the outer side of the second frictional strip would be located were such second frictional strip installed.

* * * * *